US011560301B2

(12) United States Patent
Hao

(10) Patent No.: US 11,560,301 B2
(45) Date of Patent: Jan. 24, 2023

(54) EQUINE SADDLE PAD DISPLAY SYSTEM

(71) Applicant: Tsou Meng Hao, Greenville, NC (US)

(72) Inventor: Tsou Meng Hao, Greenville, NC (US)

(73) Assignee: Partrade Trading Company LLC, Kinston, NC (US)

( * ) Notice: Subject to any disclaimer, the term of this patent is extended or adjusted under 35 U.S.C. 154(b) by 0 days.

(21) Appl. No.: 16/936,034

(22) Filed: Jul. 22, 2020

(65) Prior Publication Data

US 2020/0346918 A1 Nov. 5, 2020

Related U.S. Application Data

(63) Continuation-in-part of application No. 15/402,682, filed on Jan. 10, 2017, now abandoned.

(51) Int. Cl.

| | |
|---|---|
| ***B68C 1/12*** | (2006.01) |
| ***G09F 7/18*** | (2006.01) |
| ***B68C 1/14*** | (2006.01) |
| *G09F 23/00* | (2006.01) |

(52) U.S. Cl.

CPC ..... *B68C 1/12* (2013.01); *B68C 1/14* (2013.01); *G09F 7/18* (2013.01); *G09F 2023/005* (2013.01)

(58) Field of Classification Search

CPC .. B68C 1/12; B68C 1/126; B68C 1/20; G09F 3/08; G09F 3/14; G09F 21/02; G09F 3/18; G09F 3/185; G09F 3/20; G09F 3/201; G09F 3/207; G09F 21/023; G09F 7/18; G09F 23/00; G09F 2023/005

USPC ..... 54/65, 66, 68, 79.3; 40/300, 303, 663

See application file for complete search history.

(56) References Cited

U.S. PATENT DOCUMENTS

| | | | | |
|---|---|---|---|---|
| 2,327,823 | A | 8/1943 | Schacht | |
| 3,466,852 | A | 9/1969 | Stoner | |
| 4,352,253 | A | 10/1982 | Oswalt | |
| 4,555,435 | A | 11/1985 | Walter | |
| 4,706,610 | A | 11/1987 | Morgan, Jr. | |
| 4,739,566 | A | 4/1988 | Smith | |
| 5,154,042 | A | 10/1992 | Mooney | |
| 5,581,815 | A * | 12/1996 | Hans | A41D 13/0015 2/244 |
| 6,065,273 | A | 5/2000 | Schneider | |
| 6,273,872 | B1 | 8/2001 | Friedman | |
| 6,279,168 | B1 * | 8/2001 | Bean | A42B 1/248 2/195.1 |
| 6,279,804 | B1 | 8/2001 | Gregg | |
| 7,181,879 | B1 | 2/2007 | Key | |
| D605,381 | S * | 12/2009 | Mastrantonio | D2/891 |
| 7,770,770 | B2 | 8/2010 | Murdoch | |

(Continued)

FOREIGN PATENT DOCUMENTS

| | | | |
|---|---|---|---|
| CA | 2723533 | A1 | 5/2011 |
| DE | 10108015 | A1 | 8/2002 |

(Continued)

*Primary Examiner* — Kathleen I Alker

(74) *Attorney, Agent, or Firm* — James G. Passé; Passé Intellectual Property, LLC

(57) ABSTRACT

A saddle pad display system, especially for equine use wherein a strap loop is mounted on the pad horizontally and the display is mounted via a pair of vertical loops. This system makes it easier to add and remove the display quickly and efficiently, ensuring repetitive results. This is especially useful for a competitor or exhibitor display number.

7 Claims, 4 Drawing Sheets

(56) References Cited

U.S. PATENT DOCUMENTS

| | | | | |
|---|---|---|---|---|
| 9,144,294 | B2 | 9/2015 | Gregory | |
| 2007/0125047 | A1 | 6/2007 | Hense | |
| 2008/0109940 | A1* | 5/2008 | Van Den Heuvel ... | A42B 1/248 2/209.12 |
| 2010/0242860 | A1 | 9/2010 | Chaffin | |
| 2011/0107636 | A1 | 5/2011 | Bruner | |
| 2012/0227295 | A1 | 9/2012 | Miller | |
| 2012/0260541 | A1 | 10/2012 | Toussoun | |
| 2015/0351479 | A1 | 12/2015 | Cali | |

FOREIGN PATENT DOCUMENTS

| | | | | |
|---|---|---|---|---|
| DE | 202013003053 | U1 | 12/2013 | |
| DE | 202019001055 | U1 * | 6/2020 | ..... G09F 9/372 |
| JP | 3978543 | B2 | 9/2007 | |

* cited by examiner

EQUINE SADDLE PAD DISPLAY SYSTEM

This application is a continuation-in-part of U.S. non-provisional patent application Ser. No. 15/402,682 filed on Jan. 10, 2017, which is incorporated herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to an equine display system. In particular, it relates to a display system for use on a side of a horse saddle pad for a removable display of such things as an exhibitor number in a horse show, logo, stable name, owner, monogram, and the like.

Description of Related Art

The circumstances in which the owner of a horse or a horse rider wishes to display an item on the horse's saddle pad occur frequently (e.g., competitions). Items such as competitive numbers in shows, jewelry, logos, names, decorative design, and the like could all be displayed. Many times, such items can be embroidered or otherwise permanently affixed to the saddle pad. However, it is not uncommon that some items need to be temporarily affixed, such as a show number.

A contestant in a horse show receives a contestant number which must be displayed. However, such numbers change with each competition. Such numbers identify the horse and rider, but only for that particular competition. Accordingly, a vast number of removable systems for mounting a competitive number or any other display item have been developed for use on various types of equine saddle pads. Some of these are specific to the type and shape of the pad, while others are generic in application.

These devices all require some sort of two piece direct connection, such as a snap, or hook and loop fastener on the saddle pad. Subsequently, there will be a matching snap, or hook and loop fastener on a number holding device. These types of devices leave something on the saddle pad that is unsightly and not useful when it's not being used for attaching a number or other display. The device remaining on the saddle pad can also be an irritant if rubbed against, or the like, the rider or someone close to the horse. In one device, two metal grommets extend through the entire thickness of the saddle pad. A retaining sleeve is utilized and a strap is mounted through the grommets (or holes) for attachment, leaving a portion up against the horse. This version allows water to pass through the saddle pad holes and onto the horse. In addition, the use of metal may cause excessive irritation to the horse. Other devices have two leather or metal vertical straps on the display item on the head or neck of an animal, but not on the side of a saddle pad.

While the attempts at display systems of the prior art have attempted to solve display issues, they do not solve all the problems associated with a display on the saddle pad and there is still a need for systems which improve upon current known technology.

BRIEF SUMMARY OF THE INVENTION

The present invention solves the above issues and more by providing a horizontal cloth mounting strap which, when not in use to display a number, can have a smaller display of its own and a display holder which loops over the horizontal cloth mounting strap with at least two vertical straps, such that the display item is actually connected and hung level to the saddle pad.

Accordingly, in one embodiment, there is an equine saddle pad display system consisting of:

a) a saddle pad having an outside surface, having a single flat horizontal cloth mounting strap, having a first end and a second end, wherein the first and second ends are sewn on an outside of the saddle pad horizontally and form a loop between the horizontal cloth mounting strap and the outside surface of the saddle pad;

b) a display item having two vertically mounted cloth attachment loops, mounted on a back of the display item to hang the display item level on the horizontal cloth mounting strap; and c) wherein at least one of the horizontal cloth mounting strap and the two vertically mounted cloth attachment loops have a fastener for repeatedly opening and closing the loop.

DETAILED DESCRIPTION OF THE INVENTION

Figure 1:
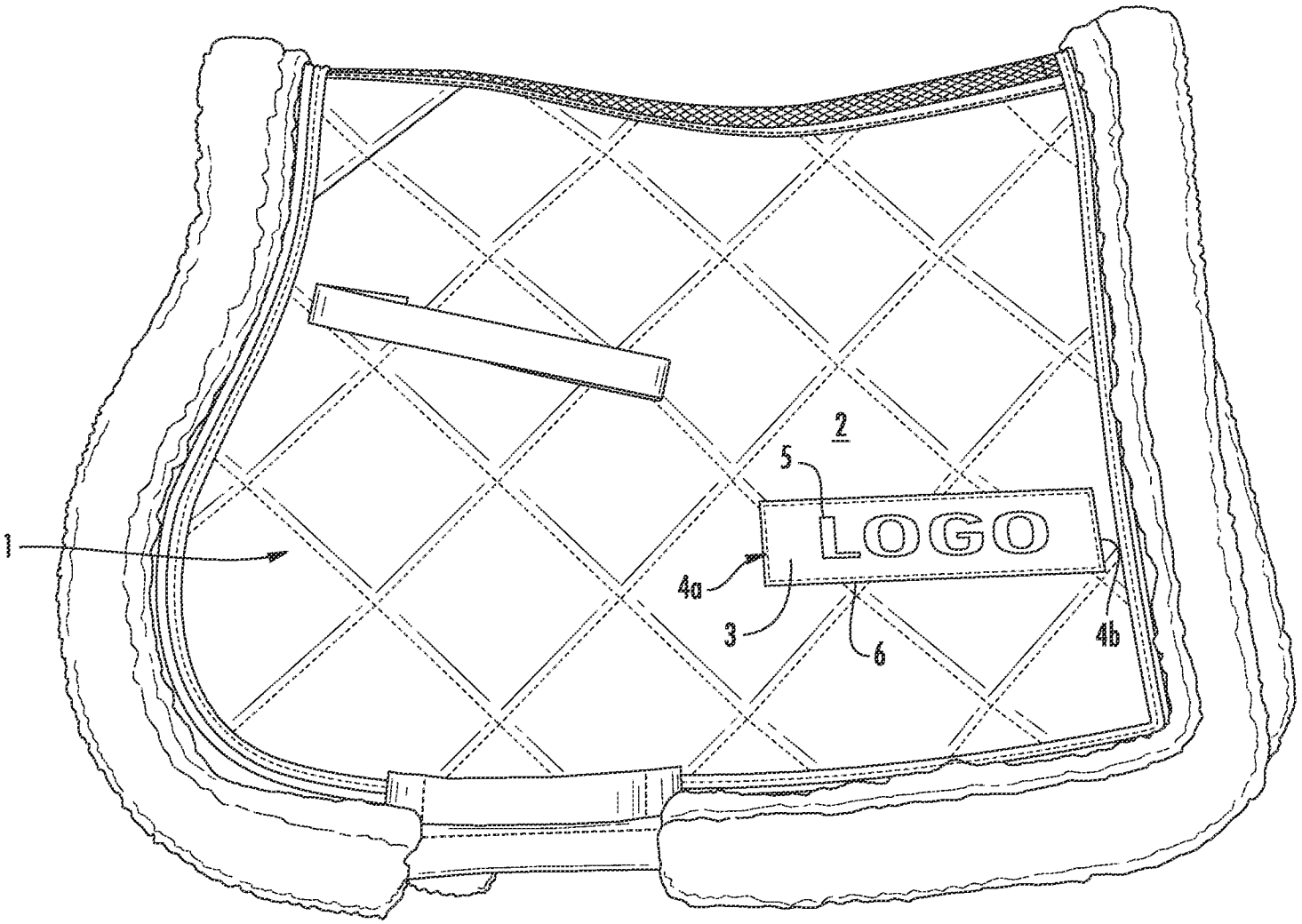
FIG. 1 is a view of a saddle pad with a horizontal cloth mounting strap of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "equine saddle pad" refers to any blanket placed between a saddle and a horse's back to prevent galling. The terms "saddle blanket", "saddle pad" (or "numnah)", "blanket" and "saddle cloth" refer to blankets, pads or fabrics inserted under a saddle and are used interchangeably. In the current invention, the saddle pad will have a portion of the pad not underneath the saddle such that a display item can be seen on it, as shown by example in the Figures. In one embodiment, the pad is an English saddle pad and in yet another embodiment, the saddle pad is a Western saddle pad.

As used herein, the term "display system" refers to a combination of a saddle pad and a display item used together so that a display item can be seen on the side of a horse. The system involves a horizontal cloth mounting strap having a first end and a second end wherein the first and second ends are sewn on an outside of the saddle pad horizontally, form a loop between the horizontal cloth mounting strap and the saddle pad, and the display item with loops perpendicular to the horizontal strap, such that the loops can be utilized to hang the display item level on the mounting strap. In one embodiment, the loops can be opened, e.g., by use of hook and loop fasteners, snaps, and the like.

As used herein, the term "display item" refers to any item that can have two vertical loops on its back and can be used to hang on the horizontal strap sewn on the saddle pad. The two vertical loops are critical in keeping the display level. Including, but not limited to, a clear pouch with or without the competitor or exhibitor number displayed therein, and an item is selected from the group consisting of a logo, a stable name, a person's name, the owner, a monogram, jewelry, and the like.

As used herein, the term "horizontal cloth mounting strap forms a loop" refers to a strip of material that is placed essentially horizontally on a visible place on the outer side of the saddle pad with the vertical ends attached by sewing them to the pad, thus forming a loop with the pad, the back part of the loop and the strap, and the front part as shown in the Figures. The exact material is not a critical element and it could be multiple materials. The only requirement is that when attached to the saddle pad, it can support the display item in the method described herein. Preferably, the loops and mounting straps are cloth. Both ends could, in one embodiment, be attached in a fixed manner and any attachment means are contemplated. The middle part of the horizontal loop is at least partially unattached to the saddle pad in order for a plurality of essentially vertical attachment loops on the display item to loop around the horizontal cloth mounting strap and hang there with the top of attachment loops resting on the top of the strap loop. Figures also show this in detail. The horizontal cloth mounting strap can be a fixed closed loop or can be one that opens and recloses by way of hook and loop fastener, snaps, or the like, since at least one of the horizontal loop and vertical attachment loops must open to hang the display item on the horizontal loop. The strap is made wide enough and tall enough to accommodate the display item and/or to accommodate any message on the front face of the horizontal cloth mounting strap. In one embodiment, the strap is from about a half an inch to about 4, 5, or 6 inches tall and in another, it is about 1 to 3 inches high. In yet another embodiment, there is any kind of message, logo, or the like permanently attached to the horizontal cloth mounting strap, such that is seen when a display item is not attached to the horizontal cloth mounting strap.

As used herein, the term "attachment loops" refers to two essentially vertical loops on a back face of the display item positioned such that they can loop around the horizontal cloth mounting strap and hang the display item thereon in a level manner. Loops of cloth or the like can be utilized as well as cloth loops made of hook and loop fasteners, which are considered cloth and open and close the loop in order to hang around on the horizontal cloth mounting strap.

As used herein, the term "hang the display item" refers to taking the display item and encircling the horizontal cloth mounting strap with the essentially vertical loops on the back of the display item. This can be accomplished by opening the horizontal cloth mounting strap and threading the horizontal cloth mounting strap through the vertical loops and then reclosing, or by opening the vertical loops and threading them through the horizontal loop before reclosing. Some form of attachment device then must be utilized to keep the loop from being opened and closed when in use.

As used herein, the term "attachment device for repeatedly opening the loop" refers to a device on one or both of the horizontal and vertical loops for opening and closing the loops. In one embodiment, it includes snaps or hook and loop fasteners. Other fastening means can be utilized. In one embodiment, the attachment device cannot be seen when the vertical loops are not attached to the horizontal loop.

DRAWINGS

Now referring to the drawings, FIG. 1 is a view of one side of a horse pad, in this view, a Western style horse pad. In this view, saddle pad 1 has saddle pad surface 2 wherein a horizontal cloth mounting strap 3 has been affixed at first and second ends 4*a* and 4*b* by sewing the ends 4*a* and 4*b* to the saddle pad surface 2. The horizontal strap 3 is adorned with a permanently printed name of the manufacturer on the pad 5. A loop area 6 is created between horizontal strap 3 and surface 2.

Figure 2:
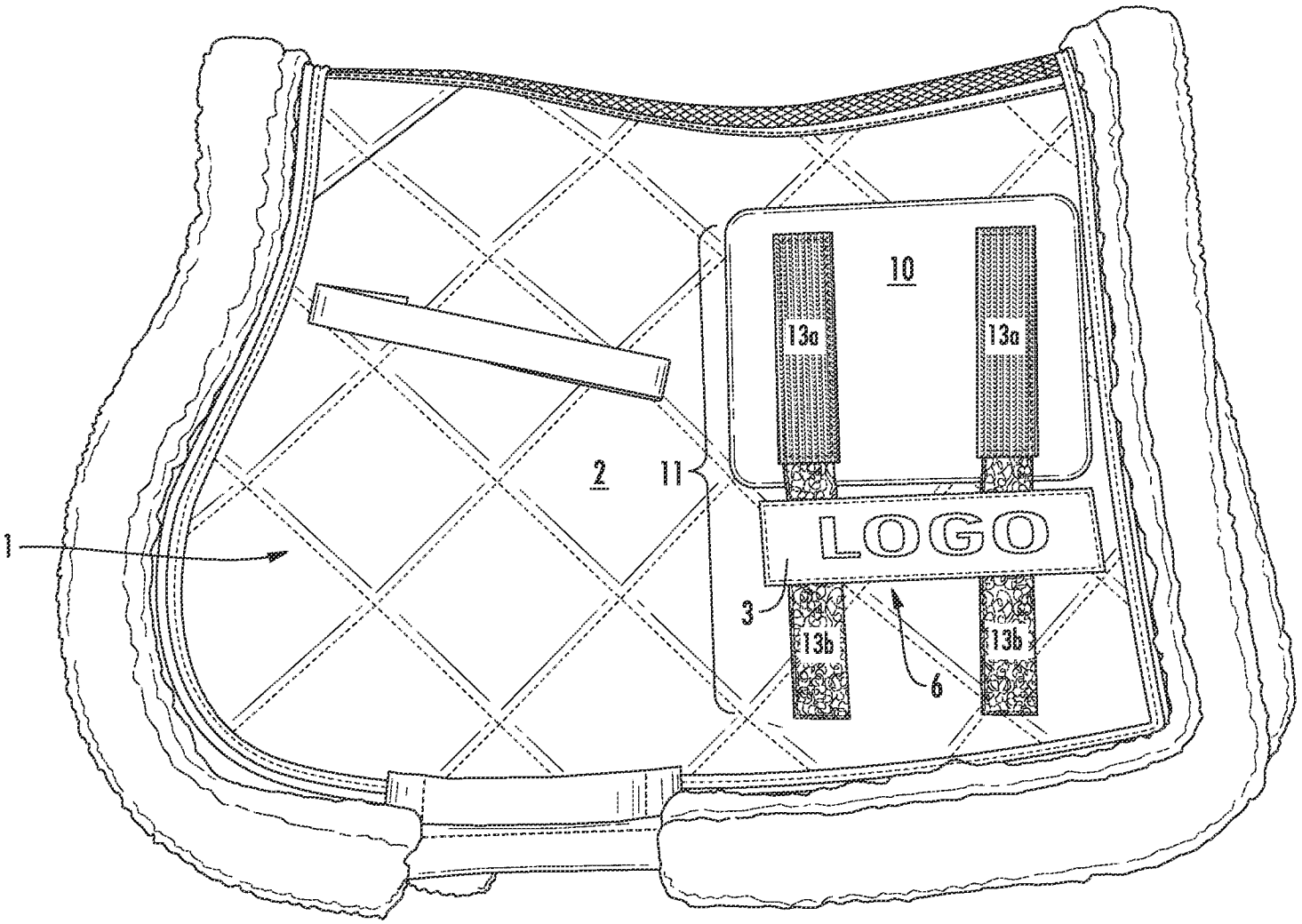
FIG. 2 is a view of a display item by installation on a horizontal cloth mounting strap of the present invention.
Figure 3:
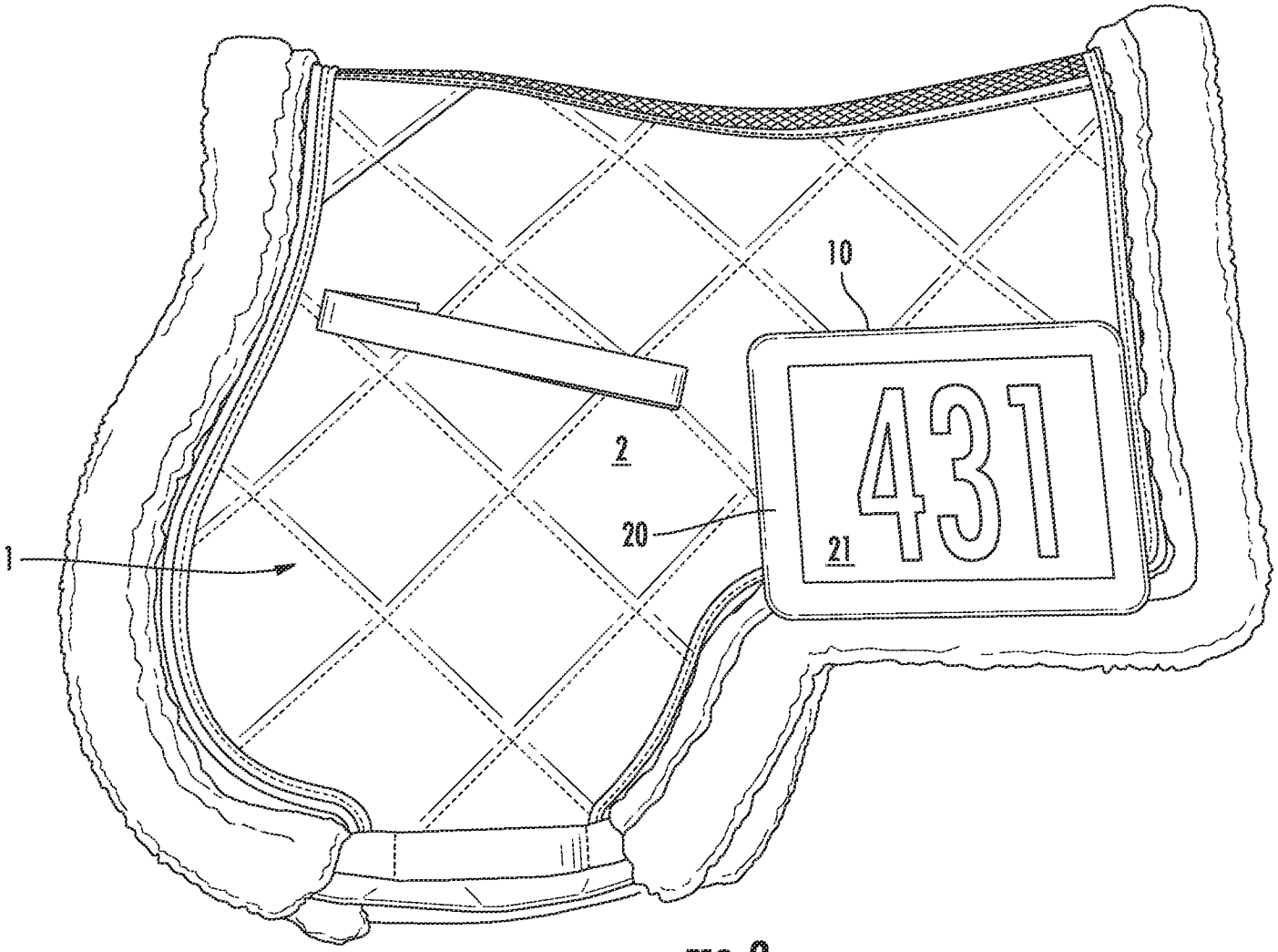
FIG. 3 is a view of the display system of the present invention.

FIG. 2 is a view of the present invention wherein the display item 10 is shown from the back and is in the process of hanging on the horizontal strap 3. In this view, there are two vertical cloth attachment loops 11 which are opened via hook 13*a* and loop 13*b* fasteners. In this view, the display item is the back of a plastic container which will house a competition number 21, as shown in FIG. 3. In FIG. 3, the display item 10 is folded back down over the horizontal strap 3 (hidden in this view), and the hook and loop fasteners attached together to form loops hanging the plastic container 20 with number 431 on the horizontal strap.

Figure 4:
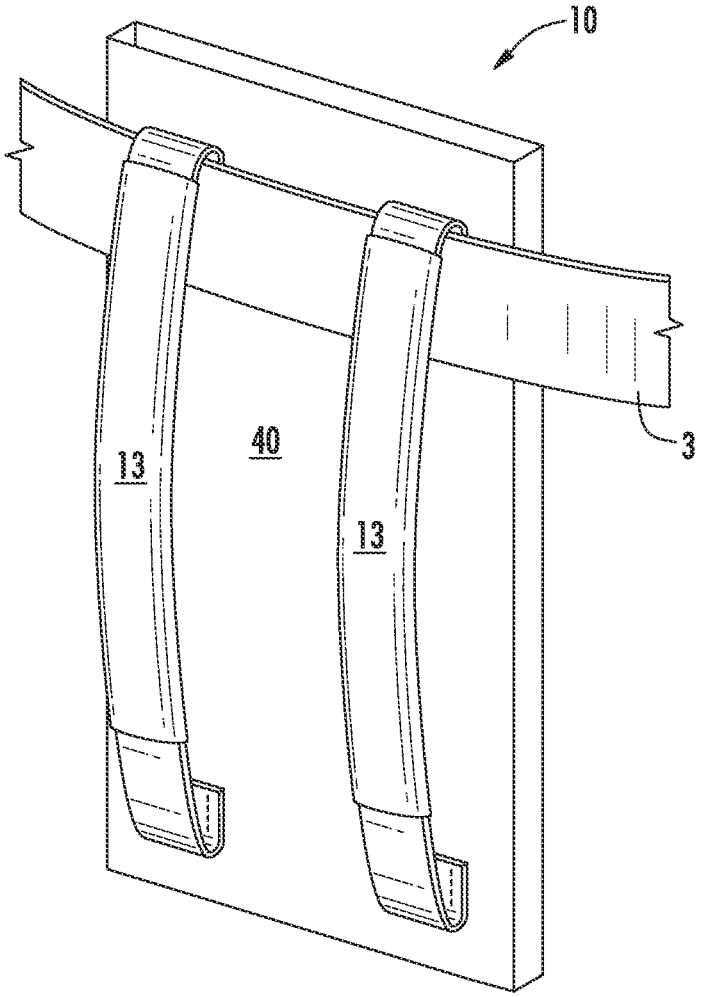
FIG. 4 is side view of the display system of the present invention.

FIG. 4 is a back perspective of the display item 10 to show what is hidden in the previous figures. In this view, display item 10 is viewed from the back 40. The two vertical attachment loops are refastened using the hook 13*a* and loop 13*b* fasteners, such that they now surround horizontal cloth mounting strap 3 and hang level therefrom. The saddle pad is left out of this view for clarity, but the horizontal cloth mounting strap is mounted on a saddle pad. It is noted that the horizontal cloth mounting strap can also open and close just like the vertical ones.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. An equine saddle pad display system consisting of:

a) an equine saddle pad having an outside surface, and having a single flat horizontal cloth mounting strap, the horizontal cloth mounting strap having a first end and a second end, wherein the first and second ends are attached on the outside of the saddle pad such that the horizontal cloth mounting strap is mounted horizontally and forms a loop between the horizontal cloth mounting strap and the outside surface of the saddle pad;

b) a clear pouch having at least two vertically mounted cloth attachment loops perpendicular to the horizontal cloth mounting strap, mounted on a back of the clear pouch to hang the clear pouch level on the horizontal cloth mounting strap loop wherein a display item is removably placed inside the clear pouch and wherein the position of the first and second ends limit horizontal movement of the clear pouch; and c) wherein the at least two vertically mounted cloth attachment loops each has a fastener for repeatedly opening and closing the vertically mounted cloth attachment loop.

2. The equine saddle pad display system according to claim 1 wherein the fastener is selected from the group consisting of a hook and loop fastener, and snaps.

3. The equine saddle pad display system according to claim 1 wherein the display item is a competitor or exhibitor number.

4. The equine saddle pad display system according to claim 1 wherein the display item is selected from the group consisting of a logo, stable name, owner, jewelry, and monogram.

5. The equine saddle pad display system according to claim 1 wherein the saddle pad is an English saddle pad.

6. The equine saddle pad display system according to claim 1 wherein the saddle pad is a Western saddle pad.

7. The equine saddle pad display system according to claim 1 wherein there is a permanent message or logo on a face of the horizontal cloth mounting strap.

* * * * *